US005775717A

United States Patent [19]

Bobrowicz

[11] Patent Number: 5,775,717

[45] Date of Patent: Jul. 7, 1998

[54] SINGLE GLIDING BOARD HAVING WEDGES FOR RAISING THE BINDINGS

[75] Inventor: Eric Bobrowicz, Monetier les Bains, France

[73] Assignee: Skis Rossignol S.A., France

[21] Appl. No.: 641,782

[22] Filed: May 2, 1996

[30] Foreign Application Priority Data

May 3, 1995 [FR] France ..... 95 05492

[51] Int. Cl.[6] ..... A63C 5/04

[52] U.S. Cl. ..... 280/607; 280/11.14

[58] Field of Search ..... 280/14.2, 602, 280/607, 609, 11.14

[56] References Cited

U.S. PATENT DOCUMENTS

| | | | |
|---|---|---|---|
| 3,900,204 | 8/1975 | Weber . | |
| 4,141,570 | 2/1979 | Sudmeier | 280/607 |
| 4,848,781 | 7/1989 | Dykema et al. . | |
| 4,867,470 | 9/1989 | Clark . | |
| 5,018,760 | 5/1991 | Remondet | 280/609 |
| 5,028,068 | 7/1991 | Donovan | 280/14.2 X |
| 5,188,386 | 2/1993 | Schweizer | 280/14.2 X |
| 5,573,264 | 11/1996 | Deville et al. | 280/602 |
| 5,580,077 | 12/1996 | Dodge | 280/607 |

FOREIGN PATENT DOCUMENTS

| | | | |
|---|---|---|---|
| 0280164 | 3/1988 | European Pat. Off. . | |
| 1598063 | 11/1970 | France . | |
| 2581322 | 7/1986 | France . | |
| 2 659 563 | 9/1991 | France | 280/609 |
| 2669237 | 9/1992 | France . | |
| 2664823 | 10/1992 | France . | |
| 2713102 | 4/1995 | France . | |
| 3910468 | 12/1988 | Germany . | |
| 93 022 013 | 11/1993 | WIPO | 280/609 |

*Primary Examiner*—Robert J. Oberleiner
*Assistant Examiner*—Pamela J. Lipka
*Attorney, Agent, or Firm*—Wall Marjama & Bilinski

[57] ABSTRACT

A single gliding board, of the type comprising:

a board (1) of maximum thickness (E) and a width (L) in the central zone, having a longitudinal axis (2) corresponding substantially to the axis along which it moves;

two bindings, respectively front (8) and rear (9), including a plate of thickness (F), each having a longitudinal mid-axis which form respective angles α and β with the longitudinal axis of the board, these bindings (8, 9) being intended to accommodate the shoes (6, 7) of the user in order to form shoe/binding assemblies (4, 5), wedges (14), of height H, for raising the bindings relative to the board (1), wherein at least one shoe/binding assembly overhangs, at least on one side of the board, by a distance (D), and wherein the height H of the wedge (14) satisfies the following formula:

$$H \geqq D-(E+F)$$

in which D represents the distance between the corner of the edge, on the one hand, and the projection of the shoe/binding assembly (4, 5) into the plane of the lower surface of the board at the outermost point (52), on the other hand.

12 Claims, 3 Drawing Sheets

SINGLE GLIDING BOARD HAVING WEDGES FOR RAISING THE BINDINGS

BACKGROUND OF THE INVENTION

The invention constitutes an improvement to the gliding boards used for both feet at once, and more precisely relates to the wedges for raising the bindings mounted on such boards.

PRIOR ART

The techniques for practicing snowboarding are continuing to develop. After a period during which snowboarding was primarily used on powdery snow, making relatively wide turns, the practice of slalom on prepared snow, with tight and fast turns is increasingly attracting snowboarders. The edges are therefore more frequently utilized, with greater tilt angles of the board.

As regards the shape of the snowboards for this mode of use, the current tendency is therefore to make the central zone of the board narrower and narrower. This makes it possible to reduce the time for switching from one edge to the other, to increase the capacity for sequencing tight turns and therefore to accelerate speed in slalom. The exertable edge pressure is also thus increased.

However, the width of the snowboard is primarily dependent on the length of the shoe of the snowboarder. The drawback found with existing snowboards is that, if the ends of the shoe overhang, there is a risk of them touching the snow when the board is tilted and therefore of causing the snowboarder to fall.

In order to use boards with high performance, which are therefore relatively narrow, some snowboarders find it necessary to alter their foot position, in particular the angle between the binding and the longitudinal axis of the snowboard, so as to prevent the ends of the shoes from coming into contact with the snow. This alteration leads to a position which is not natural for the snowboarder and which therefore does not permit optimum snowboarding.

In order to give an idea of the orders of magnitude, traditional snowboards have a central zone with a width of approximately 260 mm, while high-performance snowboards have a narrow zone with a width of approximately 160 mm.

Moreover, another way of practicing gliding using a single board is that in which the feet are arranged one behind the other on a narrow board such as, in particular, illustrated in U.S. Pat. No. 4,867,470. The position of the feet, arranged substantially one behind the other, makes it possible to use narrower boards, with a width generally between 100 and 200 millimeters, for which the risks of contact of the shoe with the snow are increasingly great.

SUMMARY OF THE INVENTION

The object of the invention is to permit the use of a single gliding board with a narrow central zone, while preventing the bindings or the shoe from catching on the snow, this being both in the case when the feet are substantially arranged across the board or in the case when they are arranged substantially along the longitudinal axis, with an even narrower board.

In order to solve this problem, the single gliding board according to the invention is of the type comprising a board of maximum thickness (E) and minimum width (L) in the central zone, having a longitudinal axis corresponding substantially to the axis along which it moves;

two bindings, respectively front and rear, including a plate of thickness (F), each having a longitudinal mid-axis and which form respective angles α and β with the longitudinal axis of the board, these bindings being intended to accommodate the shoes of the user in order to form shoe/binding assemblies, wedges, of height H, for raising the bindings relative to the board.

This board is one wherein at least one shoe/binding assembly overhangs, at least on one side of the board, by a distance (D), and wherein the height H of the wedge satisfies the following formula:

$$H \geqq D-(E+F)$$

in which D represents the distance between the corner of the edge of the ski on the one hand, and the projection of the outermost point of the shoe/binding assembly into the plane of the lower surface of the board, on the other hand.

In this way, the binding is raised by a height which is sufficient to obtain a maximum catching angle which limits the risks of contact of the shoe/binding assembly with the snow, that is to say less than the slip angle. In many applications, the height (H) should be greater than 30 mm.

It will be recalled that the catching angle is the angle formed by the plane of the lower surface of the board and the surface of the snow when the board is tilted about the lower corner of the edge in such a way that the end of the shoe/binding assembly which overhangs the board touches the snow.

The catching angle on a gliding board according to the invention is therefore equal to or greater than 45°.

In the practice of gliding on a narrow board, the user has hitherto been obliged to reduce the angle formed by his foot with the longitudinal axis of the board as much as possible in order to avoid any lateral overhang, which may prove to be uncomfortable or even unstable.

The use of a wedge according to the invention allows the snowboarder to return to a foot position which is more natural, and therefore more efficient, while retaining a satisfactory slip angle.

In order to further improve stability and the capacity for sequencing turns, a catching angle of greater than 60° is preferred, that is to say a wedge whose height H satisfies the following formula:

$$H \geqq 1.73 \cdot D-(E+F)$$

In a first embodiment, the upper face of the wedge is parallel to the upper face of the board.

In an alternative embodiment, the upper surface of the wedge is inclined toward the front of the shoe relative to the upper face of the board. In other words, the wedge raises the rear of the shoe more than the front, in order to correspond to the natural position of the user. In this case, the height H involved in the formulae is, of course, the height of the wedge at the lowermost point of the shoe/binding assembly.

In practice, the wedge is made of a material chosen from the group containing wood, metal alloys, composites and plastics.

Advantageously, the wedge also has a layer of viscoelastic material which makes it possible to absorb some of the vibrations generated by the board.

In a variant which makes it possible to reduce the weight of the gliding board and to individualize the raising of the bindings, the wedge is made in two separate parts located respectively in the anterior zone and in the posterior zone of the shoe.

In a more sophisticated form of the invention, the wedge has recesses capable of reducing its weight.

Still with the aim of obtaining a wedge which is as lightweight as possible, it may be composed of two parts, namely a block of reduced width on which a plate having dimensions compatible with the fastening of the binding rests. In this case, the height H to be considered is the distance between the top of the snowboard and the base of the shoe/binding assembly.

BRIEF DESCRIPTION OF THE DRAWINGS

The way of implementing the invention as well as the advantages which result therefrom will emerge clearly from the following embodiment description, supported by the appended figures.

EMBODIMENTS OF THE INVENTION

Figure 2:
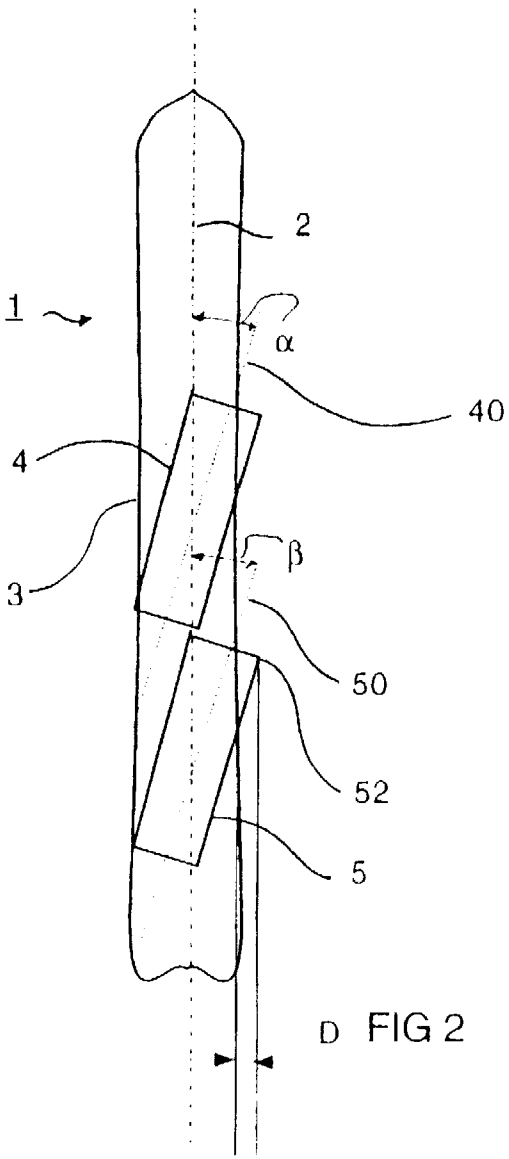
FIG. 2 is a plan view of a narrower board in which the feet are positioned substantially along the longitudinal axis of the board.
Figure 1:
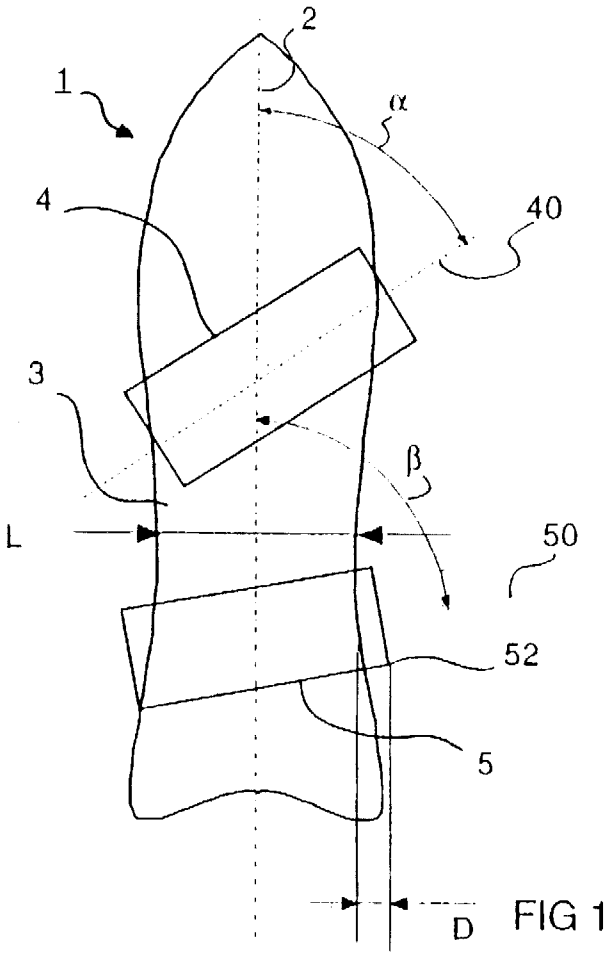
FIG. 1 is a schematic plan view of a snowboard on which the feet are substantially across the longitudinal axis of the board.

As can be seen in FIGS. 1 and 2, the single gliding board consists of a board (1) of elongate overall shape which is symmetrical with respect to a longitudinal mid-plane (2). Of course, the invention also relates to snowboards having asymmetric ends and/or outlines.

This board has a waisting in its central zone (3). The width L of this zone is an important factor because, as already stated, the current tendency is to manufacture narrower and narrower snowboards.

In a known fashion, two bindings (4, 5) are fitted to the board and are arranged inclined relative to the longitudinal axis of the board. In order to accommodate the natural position of the snowboarder, these bindings (4, 5) are placed across the longitudinal axis (2). Depending on the user and the type of snowboarding practiced, the angles of inclination are different between the front foot and the back foot. Typically, when using a board as illustrated in FIG. 1, the axis (40) of the front foot (4) is oriented at an angle ($\alpha$) of between 20° and 90° relative to the longitudinal axis (2), the toe of the foot being, of course directed toward the front of this position. For its part, the angle ($\beta$) formed by the axis (50) of the back foot (5) with the longitudinal axis (2) is between 45° and 110°, that is to say that the toe of the foot may be directed either slightly toward the front or toward the rear of the snowboard, as desired by the user. The most commonly adopted position corresponds to 45° for $\alpha$ and 80° for $\beta$.

In parallel, when using a board as illustrated in FIG. 2, in which the feet are substantially one behind the other, and where the board is relatively narrower, the axes (40, 50) of the front (4) and back (5) feet are oriented by an angle ($\alpha$, $\beta$) of between 0° and 20° relative to the longitudinal axis (2) of the board.

The shoe (6, 7) and the binding proper (8, 9) form an assembly (4, 5) whose length or width exceeds the width of the board, in particular with the new tendency to narrow snowboards.

The difference between the length of the shoe/binding assembly and the width of the snowboard at the position of this binding makes it possible to determine the portion of the shoe/binding assembly which overhangs the outside of the board, and which therefore risks catching during tight turns.

Quite clearly, for a given snowboard, this overhanging part (D) varies depending on the position of the bindings and their orientation relative to the longitudinal plane of the board.

Figure 3:
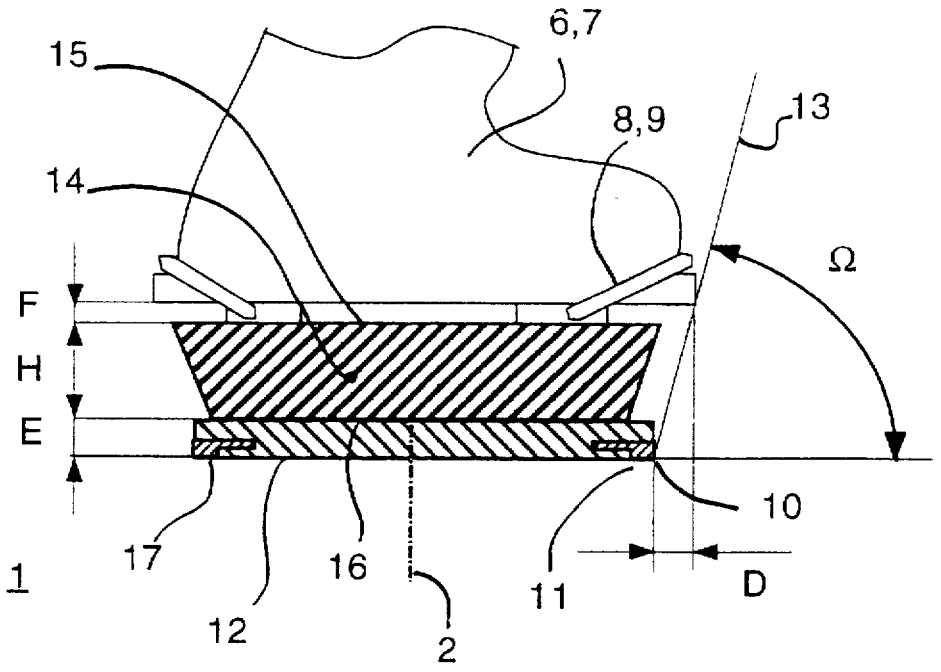
FIG. 3 is a section, through the longitudinal plane of a shoe, of the board/wedge/binding assembly, showing the characteristic parameters of the invention.

As is seen in FIG. 3, the invention consists in raising the binding (8, 9) using a wedge (14) so as to increase the value of the angle $\Omega$ which determines the limit to which the board can tilt before catching.

The vertex of this angle $\Omega$ is the corner (10) of the edge (11). It is measured between the plane (12) of the lower surface of the board (1) and the plane (13) tangent to the shoe/binding assembly (4, 5). This angle corresponds to the limit of the tilt which the board can assume during tight turns, without the binding touching the snow and therefore causing a fall.

According to the invention, this angle is chosen to be greater than 45°, and even preferably 60°, which dictates a minimum height for the raising wedge (14), this height being determined as a function of the characteristic parameters E, F and D which can be found in FIG. 3 and whose definition is given below.

E: corresponds to the thickness of the board at the axes (40, 50) of the shoe/binding assemblies (4, 5).

F: is the thickness of the binding plate, that is to say the distance between the base of the sole of the shoe and the base of the binding.

D: measures the part of the shoe/binding assembly overhanging the width of the board, that is to say the distance between the corner of the edge and the projection of the outermost point of the shoe/binding assembly into the plane of the lower surface of the board.

Of course, the quantities E, F and D are expressed with the same length unit, for example in millimeters.

Figure 4:
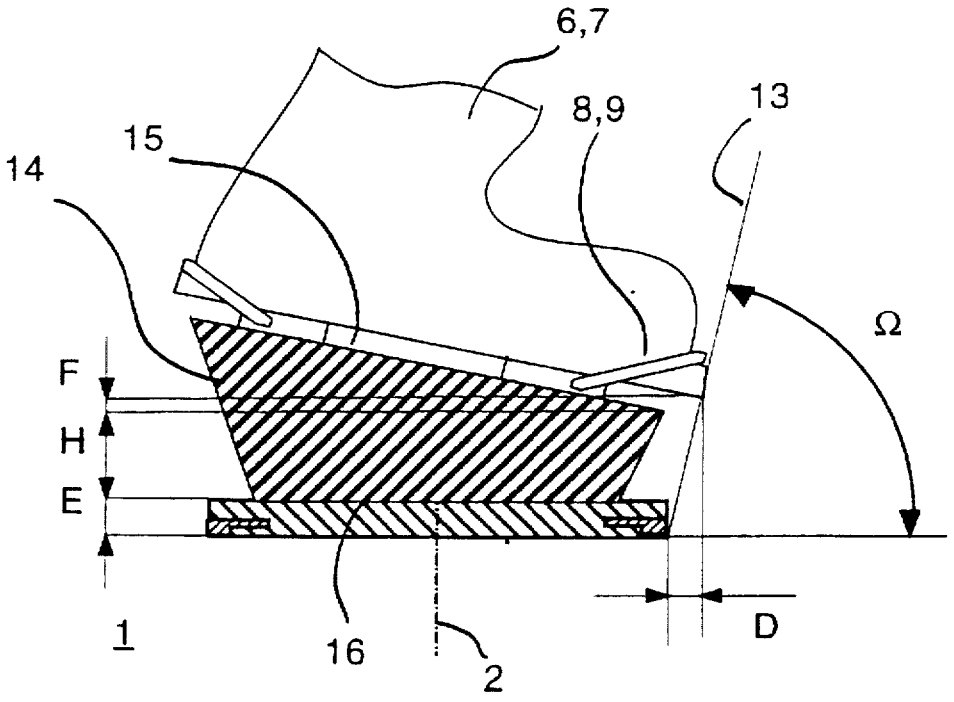
FIG. 4 illustrates a variant of the invention shown in FIG. 3, having an inclined wedge.

In a variant illustrated in FIG. 4, the wedge (14) has an upper face (15) that is inclined relative to the upper face (16) of the board (1). In some cases, this inclination corresponds to a particular natural position which is preferred by the snowboarder because it permits the user's leg to flex. In this case, the height H used for the calculation is the distance between the surface (16) and the lowermost end of the shoe/binding assembly.

Figure 5:
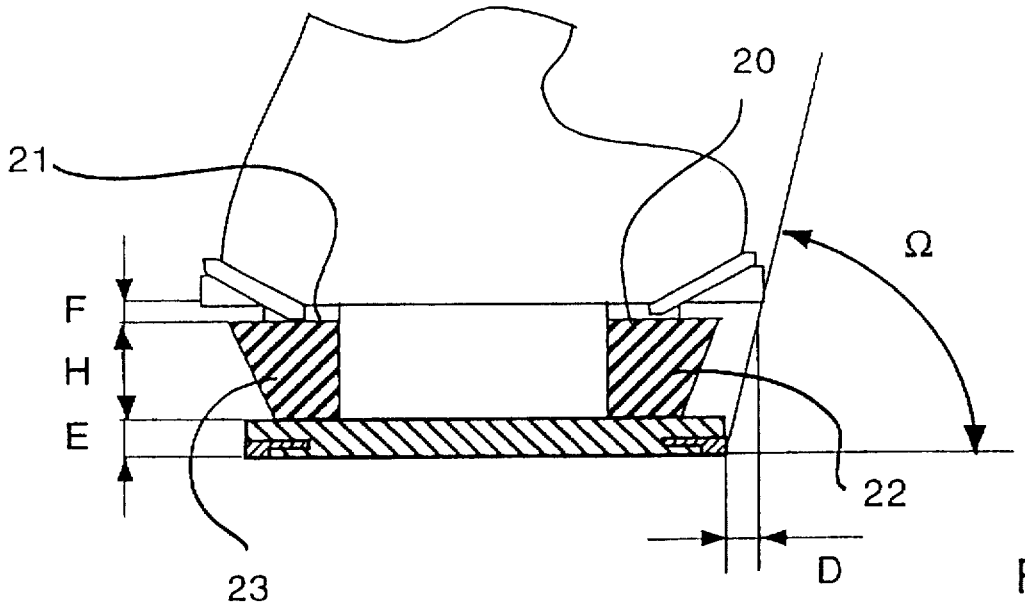
FIGS. 5 and 6 are sections, also through the longitudinal plane of a shoe, of the invention for which the wedge is in two parts, respectively juxtaposed and superposed.

In order to facilitate manufacture and assembly, it is possible to raise the front (20) and the rear (21) of the binding by using two independent wedges (22, 23) (cf. FIG. 5). In this case, an inclination similar to that in the previous variant can be obtained by choosing wedges (22, 23) of different heights.

Figure 6:
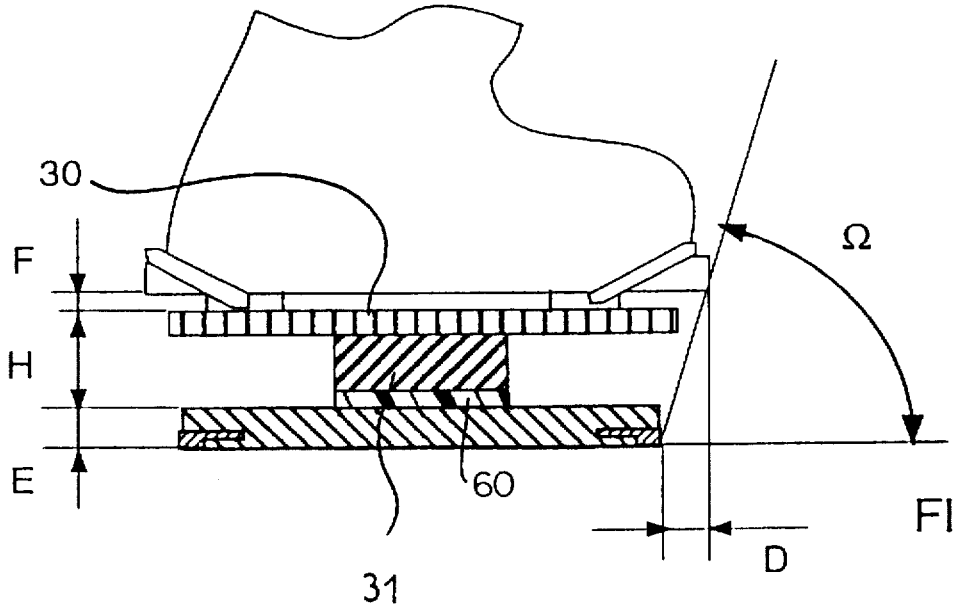

Similarly, the wedge may be made in a plurality of parts of different type and/or dimensions, as illustrated in FIG. 6. The portion (31) in contact with the board is a block with reduced supporting area, making it possible to reduce the mass of the assembly. A plate (30) to which the binding can be fitted rests above this block. In this figurative case, the height H to be considered is the total height of the assembly formed by the block (31) and the plate (30).

The characteristic wedges of the invention can be made of any materials conventionally used in the field of snowboarding, in particular wood, metal alloys, composites and plastics.

In a more sophisticated form, a layer of viscoelastic material 60 (FIG. 6) may be added to the wedge (14, 31) in order to absorb vibrations generated by the snowboard. It will be noted that these vibrations are produced more readily during aggressive snowboarding, with tight turns.

The above description clearly shows that the snowboard according to the invention combines the possibility of using a narrow snowboard (160 mm instead of the conventionally used 260 mm in the narrowest central zone) which therefore has a good capacity for sequencing rapid edge switches while retaining an optimum foot position, that is to say either with the back foot almost perpendicular to the longitudinal axis of the snowboard in the case when the feet are side by side, or with the feet oriented slightly transversely in the case when they are substantially one behind the other.

I claim:

1. A single gliding board of the type that includes a board having a maximum thickness (E) and a width (L) in a central zone thereof, said board further having a longitudinal axis that corresponds with an axis, along which the board moves, a front binding and a rear binding mounted upon said board, each binding having a plate thickness (F) and said front binding forming an angle $\alpha$ and the rear binding forming an angle $\beta$ with said longitudinal axis of said board, a securing unit associated with each of the bindings for securing a binding to the shoe of a user, wedge means of a given height (H) for raising each of the bindings relative to the board, at least one of said securing units overhanging at least one side edge of the board by a distance (D) such that the height (H) of the wedge satisfies the relationship $$H \geqq kD-(E+F)$$

wherein:

D is the distance measured from the said one edge of the board and the outermost projection of the securing unit, and k is a constant.

2. The single gliding board as claimed in claim 1, wherein the height H of the wedge (14) satisfies the following formula:

$$H \geqq 1.73 \cdot D-(E+F).$$

3. The single gliding board as claimed in claim 1, wherein the wedge (14) has a height (H) greater than 30 mm.

4. The single gliding board as claimed in claim 1, wherein an upper face (15) of the wedge (14) is parallel to an upper face (16) of the board (1).

5. The single gliding board as claimed in claim 1,wherein an upper surface (15) of the wedge (14) is inclined toward the front of a skier's shoe relative to the upper face (16) of the board (1).

6. The single gliding board as claimed in claim 1, wherein the wedge (14) is made of a material chosen from the group containing wood, metal alloys, composites and plastics.

7. The single gliding board as claimed in claim 1, wherein the wedge (14) contains a layer of viscoelastic material.

8. The single gliding board as claimed in claim 1, wherein the wedge (14) is made in two separate parts (22, 23) located respectively in the anterior zone (20) and in the posterior zone (21) of a skier's shoe.

9. The single gliding board as claimed in claim 1, wherein the wedge (14) has recesses capable of reducing the weight of said wedge.

10. The single gliding board as claimed in claim 1, wherein the wedge (14) is composed of a plurality of parts, namely a block (31) of reduced width on which a plate (30) having dimensions compatible with the fastening of the binding (8, 9) rests.

11. The single gliding board as claimed in claim 1, wherein the width (L) in the central zone is between 100 and 200 millimeters, and wherein the angles $\alpha$ and $\beta$ are less than 45°.

12. The single gliding board of claim 1 wherein said rear binding has a longitudinal mid-axis that intersects the longitudinal axis of said board at an angle of between 45° and 90° and wherein the width of the board is between 240 and 300 mm.

* * * * *